United States Patent [19]

Herd et al.

[11] Patent Number: 4,474,672

[45] Date of Patent: Oct. 2, 1984

[54] REDUCING THE CLOUD POINT OF HYDRODEWAXED BASE STOCKS

[75] Inventors: Richard S. Herd; Phillip S. Landis, both of Woodbury, N.J.

[73] Assignee: Mobil Oil Corporation, New York, N.Y.

[21] Appl. No.: 456,918

[22] Filed: Jan. 10, 1983

[51] Int. Cl.[3] ..... C10M 1/12; C10M 1/54

[52] U.S. Cl. ..... 252/40.7; 252/31; 252/46.4; 252/45

[58] Field of Search ..... 252/40.7, 45, 46.4, 252/31; 208/18, 19

[56] References Cited

U.S. PATENT DOCUMENTS 3,278,432 10/1966 Davis ..... 252/40.7

3,972,853 8/1976 Gorring et al. ..... 252/45

*Primary Examiner*—Jacqueline V. Howard

*Attorney, Agent, or Firm*—Alexander J. McKillop; Michael G. Gilman; Claude E. Setliff

[57] ABSTRACT

The cloud point of a hydrodewaxed base stock is reduced by direct sulfurization of the base stock, or by direct sulfurization of the base stock in the presence of a magnesium, calcium or barium compound.

8 Claims, No Drawings

REDUCING THE CLOUD POINT OF HYDRODEWAXED BASE STOCKS

BACKGROUND OF THE INVENTION

1. Field of the Invention

This invention concerns a method for reducing the cloud point of a hydrodewaxed base stock. More particularly, it relates to a method of lowering the cloud point of a base stock by treating same with sulfur to provide a low sulfur concentration, either alone or in the presence of a magnesium, calcium or barium compound.

2. Discussion of the Prior Art

Many hydrodewaxed base oils have relatively high cloud points. While other properties are excellent and the cloud point appears to have no deleterious effect on the performance of formulated oils, nevertheless, there are specification tests for many oils that require that there be no overnight cloud formation in the base oil at a given temperature, often 30° F. to 40° F.

The high cloud point (or overnight cloud point, ONC) is common to many hydrodewaxed oils. Much processing work, such as selective removal of the haze components and use of crystallization inhibitors, has been done with limited success. Generally, solutions to the haze formation are uneconomic or impractical because the solutions introduce other problems such as lower viscosity index, poor storage stability, dark color, water emulsification tendency, poorer oxidation response, and the like.

No prior art is known that teaches or suggests that the herein disclosed useful results can be obtained by reacting a mineral oil base stock with sulfur to give the low sulfur concentrations of the invention. It is known, however, that sulfur has been reacted with mineral oils to produce $H_2S$ or to provide corrosive oils for cutting purposes or to impart antiwear properties to oils.

SUMMARY OF THE INVENTION

In accordance with the invention, there is provided a method for lowering the cloud point of a hydrodewaxed mineral oil base stock which comprises reacting sulfur therewith in proportions to provide from about 0.01% to about 0.2% by weight thereof in said oil. Alternatively, sulfurization may be carried out in the presence of an oil soluble magnesium, calcium or barium compound to reduce the color level as well as to lower the cloud point.

DESCRIPTION OF SPECIFIC EMBODIMENTS

The method disclosed herein is generally applicable to any hydrodewaxed mineral oil susceptible to haze formation at lower temperatures. Although, as has been stated hereinabove, such haze formation does not affect other properties of the oil, specifications have been established by some companies which require oils to pass an overnight cloud point of 30° F. or higher.

In carrying out the method, oil is mixed with sufficient sulfur compound to provide from about 0.01% to about 0.2% thereof in the oil, and the mixture is heated at from about 150° C. to about 250° C., preferably from about 180° C. to about 220° C. until the reaction is complete. The reaction typically will require from 1 to 5 hours. Since this treatment generally causes color to develop, we may use a magesium, calcium or barium compound in the oil during reaction to reduce the color level. The metal compound is used in small amounts, usually on the order of from about 0.01% to about 1.0%, and preferably about 0.01% to 0.1%, based on the weight of the oil.

During the reaction between oil and sulfur, small amounts of hydrogen sulfide are formed. To remove this by-product oxygen, nitrogen or other inert gas is blown through or over the medium.

The haze component is present in the oil in very small amounts, often less than 0.1% by weight of the oil. We believe that equally small amounts of sulfur compounds formed in the oil are effective because the sulfur reacts in part with organic structures present to produce small amounts of organo-sulfur compounds, which in turn solubilize the haze component and prevent its crystallization at a given lower temperature.

One specific problem area is with Aldelaide MLDW bright stock, having the following properties:

SVS@210° F.=150
VI=95
Pour Point=20° F.
CCR=1.1%
% S=1.2
ASTM Color=2.5
Mass Spec:
- 15% paraffins
- 14% mononaphthenes
- 25% polynaphthenes
- 48% aromatics This oil, without the sulfur compound produces a visible haze on storage overnight at 30° F., which disappears at higher temperatures (but which will reform on cooling again). Several compounds not containing sulfur were tested as solubilizers for the haze component, only a few of which showed any effect at all. However, such high concentrations of these were required to make them effective that their use was economically impracticable. Further, the high concentrations required introduced other undersirable properties to the base fluid.

Having described the invention in general terms, the following Examples are offered as specific embodiments. It will be understood that they are illustrative of the invention and are not intended to limit its scope.

EXAMPLE 1

One hundred grams of Adelaide MLDW Bright Stock and 0.05 grams of sulfur were charged into a 250 ml, 4 neck round bottom flask equipped with a thermometer, glass "paddle" stirrer and nitrogen inlet tube. The contents were heated to 160° C. and held for 3 hours with a stream of nitrogen above surface. The sulfurized product was cooled to 90° C. and filtered through diatomaceous earth.

The product contained 0.05% sulfur.

EXAMPLE 2

Eighty-four grams of Adelaide MLDW Bright Stock and 0.084 grams of sulfur were charged into a 250 ml, 4 neck round bottom flask equipped with a thermometer, glass "paddle" stirrer and nitrogen inlet tube. The contents were heated to 180° C. and held for 2 hours with a stream of nitrogen above surface. The sulfurized product was cooled to 90° C. and filtered through diatomaceous earth.

The product contained 0.1% sulfur.

EXAMPLE 3

Ninety-nine and eight tenths grams of Adelaide MLDW Bright Stock and 0.2 grams of sulfur were charged into a 250 ml, 4 neck round bottom flask equipped with a thermometer, glass "paddle" stirrer and nitrogen inlet tube. The contents were heated to 200° C. and held for 2 hours with a stream of nitrogen above surface. The sulfurized product was cooled to 90° C. and filtered through diatomaceous earth.

The product contained 0.2% sulfur.

EXAMPLE 4

Two hundred grams of adelaide MLDW Bright Stock, 0.043 grams of sulfur and 0.4 grams of magnesium-$C_{10}$ salicylate (made by reacting salicylic acid with decyl alcohol, then with a magnesium halide) were charged into a 500 ml, 4 neck round bottom flask equipped with a thermometer, glass "paddle" stirrer and nitrogen inlet tube. The contents were heated to 180° C. and held for 2 hours with a stream of nitrogen above surface. The sulfurized product was cooled to 90° C. and filtered through diatomaceous earth.

The product contained 0.02% sulfur and 0.2% of the Mg compound (0.004% Mg).

EXAMPLE 5

Two hundred grams of Adelaide MLDW Bright Stock, 0.4 grams of sulfur and 0.1 grams of magnesium-$C_{10}$ salicylate were charged into a 500 ml, 4 neck round bottom flask equipped with a thermometer, glass "paddle" stirrer and nitrogen inlet tube. The contents were heated to 180° C. and held for 2 hours with a stream of nitrogen above surface. The sulfurized product was cooled to 90° C. and filtered through diatomaceous earth.

The product contained 0.2% sulfur and 0.05% of the Mg compound (0.004% Mg).

EVALUATION OF OILS

Samples of the oil were heated to 212° F. for 45 minutes and were then placed in a cold room, maintained at 30° F. overnight (actually, for a total of about 16 hours) and were evaluated for haze by nephelometric determination. Numbers higher than 10 indicate visible haze, but do show some improvement if below the value for the oil per se.

Results are shown in the following table.

TABLE 1

OVERNIGHT CLOUD POINT TEST RESULTS WITH ALDELAIDE MLDW BRIGHT STOCK (HYDRODEWAXED)

| | Wt. % Conc. of sulfur In Adelaide Bright Stock | Overnight Cloud Point |
|---|---|---|
| Adelaide Bright Stock | — | 33 |
| Example 1 | 0.05 | 19 |
| Example 4 | 0.02 | 9 |

While the invention has been illustrated with sulfur, it is contemplated that sulfur compounds will be operative. These include dioctyl sulfide, didodecyl sulfide, dimethyl disulfide, di-t-butyl disulfide, sulfurized butene-1, sulfurized cis-butene-2, sulfurized trans-butene-2, sulfurized mixed butenes, sulfurized octene, sulfurized decene trimer and sulfurized decene dimer.

What is claimed is:

1. A method for lowering the cloud point of a hydrodewaxed mineral oil base stock which comprises reacting sulfur with said base stock in sufficient quantity to provide from about 0.01% to about 0.2% by weight of sulfur therein.

2. The method of claim 1 wherein there is present during sulfurization from about 0.01% to about 1.0% of an oil soluble magnesium, calcium or barium compound based on the weight of the oil.

3. The method of claim 1 wherein the reaction is carried out at from about 150° C. to about 250° C.

4. The method of claim 2 wherein the oil soluble compound is a magnesium compound.

5. The method of claim 4 wherein the magnesium compound is magnesium-$C_{10}$ salicylate.

6. A lubricating oil composition consisting essentially of (1) a hydrodewaxed mineral oil base stock having reacted therewith from about 0.01% to about 0.2% by weight of sulfur and (2) from about 0.01% to about 1.0% by weight of an oil soluble magnesium, calcium or barium compound.

7. The composition of claim 6 wherein the oil soluble compound is a magnesium compound.

8. The composition of claim 7 wherein the magnesium compound is magnesium-$C_{10}$ salicylate.

* * * * *